US007707600B1

(12) United States Patent
Ramanathan

(10) Patent No.: US 7,707,600 B1
(45) Date of Patent: Apr. 27, 2010

(54) CONFIRMING VIDEO TRANSMISSIONS

(75) Inventor: Ramanathan Ramanathan, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 1076 days.

(21) Appl. No.: 09/138,807

(22) Filed: Aug. 21, 1998

(51) Int. Cl.
*H04H 60/32* (2008.01)

(52) U.S. Cl. ..... 725/20; 725/22; 725/32; 725/34; 725/112; 725/136; 348/432.1; 348/434.1; 348/476; 348/477; 455/3.01; 455/3.03; 455/3.05; 709/231; 709/236; 714/704; 714/774; 714/748

(58) Field of Classification Search ..... 725/20, 725/22, 112, 136; 348/432.1, 434.1, 476, 348/477; 455/3.01, 3.03, 3.05; 709/231, 709/236; 714/704, 774, 748, 449
See application file for complete search history.

(56) References Cited

U.S. PATENT DOCUMENTS 4,230,990 A * 10/1980 Lert et al. ..... 348/473
4,241,398 A * 12/1980 Carll ..... 709/236
4,736,369 A * 4/1988 Barzilai et al. ..... 370/231
4,805,020 A * 2/1989 Greenberg ..... 348/460
4,805,167 A * 2/1989 Leslie et al. ..... 370/540
4,912,552 A * 3/1990 Allison et al. ..... 725/21
5,090,011 A * 2/1992 Fukuta et al. ..... 370/230
5,111,292 A * 5/1992 Kuriacose et al. ..... 375/240.01
5,200,822 A * 4/1993 Bronfin et al. ..... 348/473
5,253,275 A * 10/1993 Yurt et al. ..... 375/240
5,349,678 A * 9/1994 Morris et al. ..... 709/219
5,355,161 A * 10/1994 Bird et al. ..... 348/907
5,374,951 A * 12/1994 Welsh ..... 379/92.04
5,390,188 A * 2/1995 Dawson ..... 714/717
5,426,640 A * 6/1995 Hluchyj et al. ..... 370/235
5,434,847 A * 7/1995 Kou ..... 370/252
5,440,334 A * 8/1995 Walters et al. ..... 725/92
5,446,489 A * 8/1995 Egendorf ..... 725/1
5,450,122 A * 9/1995 Keene ..... 725/20
5,526,427 A * 6/1996 Thomas et al. ..... 348/461
5,568,645 A * 10/1996 Morris et al. ..... 709/203
5,584,050 A * 12/1996 Lyons ..... 455/67.1
5,613,195 A * 3/1997 Ooi ..... 455/13.2
5,627,970 A * 5/1997 Keshav ..... 709/233
5,646,675 A * 7/1997 Copriviza et al. ..... 725/20

(Continued)

OTHER PUBLICATIONS

JMF Solutions: Transmitting Audio and Video Using RTP, 1995, pp. 1-2.*

(Continued)

*Primary Examiner*—Jason P Salce
(74) *Attorney, Agent, or Firm*—Trop, Pruner & Hu, P.C.

(57) ABSTRACT

In an interactive broadcasting system, television programming may be broadcast with interleaved web content information. The progress in broadcasting the web content information over one or more transports and over one or more channels within those transports, may be monitored to provide a time based indication of what content has been broadcast. In one embodiment, markers may be inserted into the data transmission flow and a method may be utilized to associate a handle with a particular marker. A method may be called which obtains the handle and another method may be utilized to invoke the handle to obtain current information about broadcast transmissions. This information may be used within a broadcast encoder or may be provided to a content provider, for example, through a log-in server.

30 Claims, 4 Drawing Sheets

U.S. PATENT DOCUMENTS 5,680,322 A * 10/1997 Shinoda ..... 714/18
5,737,025 A * 4/1998 Dougherty et al. ..... 348/467
5,745,504 A * 4/1998 Bång ..... 714/752
5,751,969 A * 5/1998 Kapoor ..... 709/235
5,764,626 A * 6/1998 VanDervort ..... 370/232
5,784,597 A * 7/1998 Chiu et al. ..... 713/401
5,793,976 A * 8/1998 Chen et al. ..... 709/224
5,805,203 A * 9/1998 Horton ..... 725/119
5,826,165 A * 10/1998 Echeita et al. ..... 348/903
5,835,771 A * 11/1998 Veldhuizen ..... 717/154
5,854,897 A * 12/1998 Radziewicz et al. ..... 709/224
5,889,957 A * 3/1999 Ratner et al. ..... 709/227
5,894,479 A * 4/1999 Mohammed ..... 370/401
5,894,589 A * 4/1999 Reber et al. ..... 725/6
5,913,039 A * 6/1999 Nakamura et al. ..... 709/231
5,918,020 A * 6/1999 Blackard et al. ..... 709/228
5,930,252 A * 7/1999 Aaker et al. ..... 370/395.2
5,949,410 A * 9/1999 Fung ..... 715/500.1
5,956,716 A * 9/1999 Kenner et al. ..... 707/10
6,014,693 A * 1/2000 Ito et al. ..... 709/219
6,018,768 A * 1/2000 Ullman et al. ..... 709/218
6,031,818 A * 2/2000 Lo et al. ..... 370/216
6,031,833 A * 2/2000 Fickes et al. ..... 370/349
6,061,719 A * 5/2000 Bendinelli et al. ..... 709/218
6,064,438 A * 5/2000 Miller ..... 345/723
6,081,907 A * 6/2000 Witty et al. ..... 714/6
6,084,631 A * 7/2000 Tonkin et al. ..... 348/211.6
6,091,709 A * 7/2000 Harrison et al. ..... 370/235
6,091,777 A * 7/2000 Guetz et al. ..... 375/240.11
6,097,441 A * 8/2000 Allport ..... 348/120
6,128,649 A * 10/2000 Smith et al. ..... 709/217
6,141,032 A * 10/2000 Priest ..... 348/14.13
6,144,375 A * 11/2000 Jain et al. ..... 715/500.1
6,144,636 A * 11/2000 Aimoto et al. ..... 370/229
6,173,271 B1 * 1/2001 Goodman et al. ..... 348/907
6,182,139 B1 * 1/2001 Brendel ..... 709/226
6,192,410 B1 * 2/2001 Miller et al. ..... 709/232
6,198,783 B1 * 3/2001 Campana, Jr. ..... 375/346
6,215,774 B1 * 4/2001 Knauerhase et al. ..... 370/252
6,275,471 B1 * 8/2001 Bushmitch et al. ..... 370/248
6,279,157 B1 * 8/2001 Takasu ..... 725/20
6,295,092 B1 * 9/2001 Hullinger et al. ..... 348/468
6,297,845 B1 * 10/2001 Kuhn et al. ..... 348/180
6,304,567 B1 * 10/2001 Rosenberg ..... 370/356
6,308,328 B1 * 10/2001 Bowcutt et al. ..... 725/111
6,310,892 B1 * 10/2001 Olkin ..... 370/473
6,317,441 B1 * 11/2001 Nakajima ..... 370/509
6,330,033 B1 * 12/2001 Cooper ..... 348/192
6,351,281 B1 * 2/2002 Cooper ..... 324/617
6,353,929 B1 * 3/2002 Houston ..... 725/20
6,356,309 B1 * 3/2002 Masaki et al. ..... 348/439.1
6,356,555 B1 * 3/2002 Rakib et al. ..... 370/441
6,400,407 B1 * 6/2002 Zigmond et al. ..... 348/465
6,401,121 B1 * 6/2002 Yoshida et al. ..... 709/227
6,415,438 B1 * 7/2002 Blackketter et al. ..... 725/136
6,445,717 B1 * 9/2002 Gibson et al. ..... 370/473
6,459,427 B1 * 10/2002 Mao et al. ..... 725/109
6,519,226 B1 * 2/2003 Kumar et al. ..... 370/230
6,526,049 B1 * 2/2003 Murata ..... 370/389
6,983,478 B1 * 1/2006 Grauch et al. ..... 725/13

OTHER PUBLICATIONS

RFC 1889 "RTP: A Transport Protocol for Real-Time Applications", Audio-Video Transport Working Group, Jan. 1996.*

RPI Library API Specification, http://www-out.bell-labs.com/project/RTPlib/DOCS/rtp_api.html, Jun. 1998.*

Microsoft Windows For Workgroups & MS-DOS, Microsoft Corporation, 1994, see Chapter 2, pp. 16-17 and 77-81.*

2Lt David Chaboya, Intrusion Detection Utilizing Ethereal, 1997, United States Air Force, all pages.*

Kessler, A Primer on Internet and TCP/IP Tools, Dec. 1994, Hill Associates, Inc., section 2.4.*

Postel, Internet Control Message Protocol, Sep. 1981, ISI, all pages.*

Comer, Computer Networks and Internets, 1999, Prentice-Hall, Second Edition, pp. 11-13.*

Kessler et al., A Primer On Internet and TCP/IP Tools, Dec. 1994, p. 4.*

* cited by examiner

CONFIRMING VIDEO TRANSMISSIONS

BACKGROUND

This invention relates generally to video transmissions such as interactive broadcasting which involves, for example, broadcasting television programming together with web content.

A broadcast encoder interleaves, or multiplexes, television programming and web content and transmits it over a transport. A given transport could have a variety of different bandwidths. For example, one transport may be an airwave broadcasting system where the web content is provided over the vertical blanking interval (VBI). Other transports of potentially greater bandwidths include cable and satellite transmissions.

A content provider may provide television programming or the web content information to a broadcast encoder which then transmits the broadcast to a plurality of users over one or more transports. The users may receive the broadcast using a computer adapted television receiver. Thus, the user station may involve a set-top computer which operates a television receiver or a conventional computer equipped with a television capture card.

Because of bandwidth limitations and the availability of multiple transport mechanisms, it may be difficult for the broadcast encoder to report when a particular broadcast has actually occurred. For example, a particular piece of web content information may be routed over available bandwidths. During busy periods, these bandwidths may be tied up for considerable amounts of time or the available transmission bandwidths may be relatively limited. Therefore, it may not be determinable in advance, in all cases, exactly when a particular transmission will occur, how long it may take to complete the transmission, and when the transmission will be completed.

This lack of transmission certainty may be a problem for the content provider who may need to know when a transmission has been completed and how long a particular broadcast encoder takes to transmit the content provider's web content. This may be important in a variety of settings including determining whether a particular broadcaster has complied with its contractual obligations to broadcast a particular item and in ensuring that users have received information which may be critical to subsequent transmissions or subsequent activities. The content provider may not be able to proceed with other transmissions or activities until it knows that an initial transmission has been received.

Thus, there is a need, in connection with interactive broadcasting, for providing confirmation services.

SUMMARY

In accordance with one embodiment, a method for tracking video transmissions includes setting a first marker in the transmission data. Transmission after the first marker is tracked and reported.

DETAILED DESCRIPTION

Figure 1:
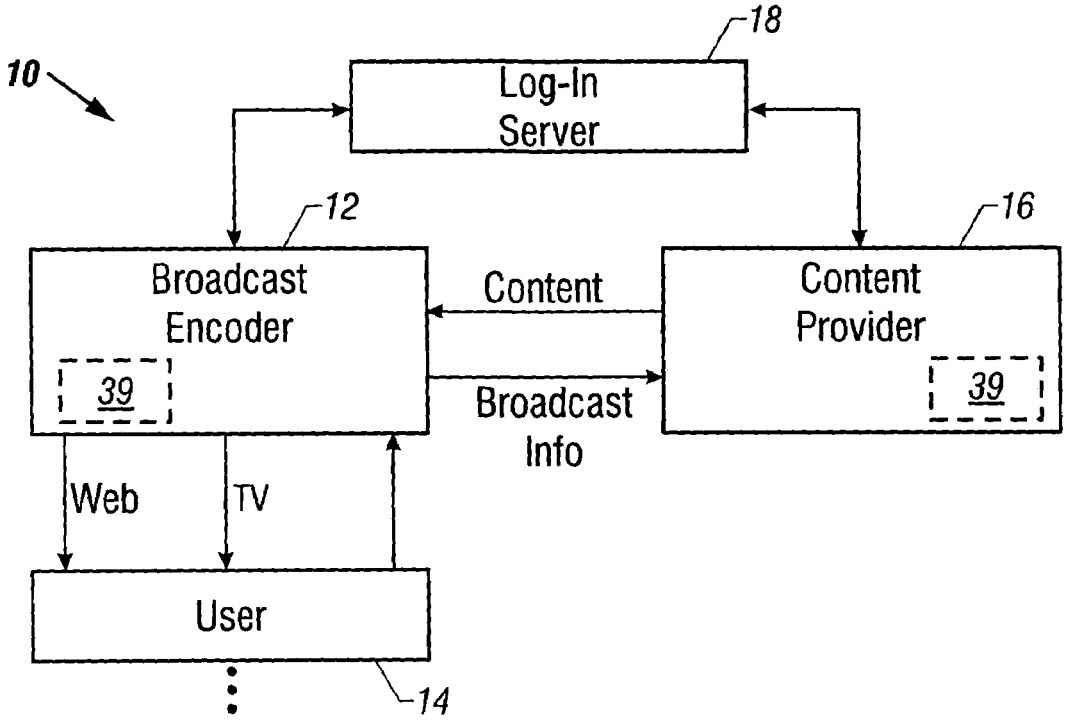
FIG. 1 is a conceptual depiction of an interactive broadcasting system in accordance with one embodiment of the present invention.

An interactive broadcasting system 10, shown in FIG. 1, allows a broadcast encoder to multiplex web content and television programming, and to broadcast the multiplexed information to a group of users 14. The broadcast encoder 12 may receive the content from a content provider 16. Periodically, the broadcast encoder may report on broadcast progress to the content provider. In addition, the broadcast encoder may provide a log-in server 18 which allows the content provider to check on the progress of commissioned broadcasts. Software may be provided in a memory 39 on either or both of the broadcast encoder 12 and the content provider 16 to provide broadcast tracking services.

While the illustrative embodiments relate to broadcasts, the present invention is applicable to other video transmissions such as multicasting. In addition, while a broadcast of television content is illustrated, non-television content may be encompassed as well.

Figure 2:
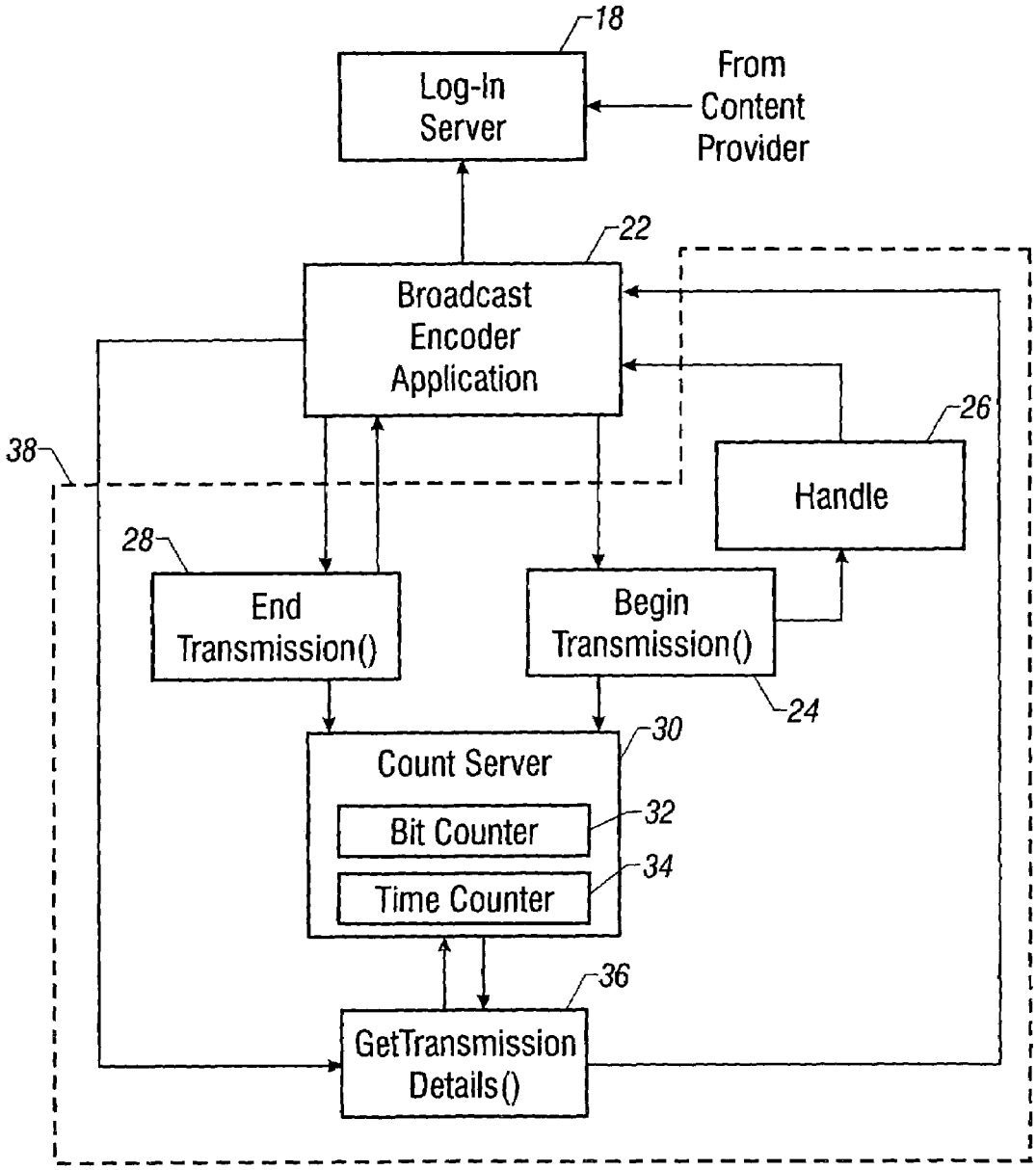
FIG. 2 illustrates a tracking system useful in the embodiment shown in FIG. 1.

Referring to FIG. 2, software 38 may interact with a broadcast encoder application 22. The broadcast encoder application software may report tracking information received from the tracking software 38 to the log-in server 18 so that the tracking information may be made accessible to the content provider.

When the broadcast encoder application 22 wishes to obtain tracking services, it initiates the BeginTransmission( ) method 24. The broadcast encoder application 22 may obtain tracking services either upon request from the content provider or upon its own initiative.

The BeginTransmission( )method 24 (as well as other methods mentioned herein) may be a method available in an object-oriented programming language such as COM, ActiveX, or Java. In addition, function calls or Application Program Interfaces (APIs) may be utilized with non-object oriented programming languages to implement such tasks.

When the BeginTransmission( )method 24 is called, the method obtains a handle 26 and returns the handle to the broadcast encoder application 22. The handle provides a pointer to a marker within the broadcast data stream.

When the broadcast encoder application 22 wishes to obtain information about broadcast details, it may call the GetTransmissionDetails( ) method 36. The method 36 returns a variety of transmission details to the broadcast encoder application 22. It can provide information about how much information has been sent, how much information has been received, whether information was lost, whether data has been cached, and other pertinent details.

The method 36 calls a count server 30 which includes a bit counter 32 and a time counter 34. The count server 30 counts transmitted bits and elapsed time. Thus, the GetTransmissionDetails( ) method 36 provides an indication of current transmission details as obtained from the count server 30. The GetTransmissionDetails( ) method 36 may be called at any time to give tracking information current as of that particular time.

The broadcast encoder application 22 uses the handle 26 it received previously to obtain the appropriate transmission details. In any given data transmission, there may be a number of markers which may be placed in the data flow either by the broadcast encoder 12 or the content provider 16. By identifying a particular handle, associated with a particular marker, the broadcast encoder application 22 receives the particular tracking information, associated with a particular marker, which is desired.

The broadcast encoder application can also call the EndTransmission( ) method 28. The method 28 communicates with count server 30 and completes a given tracking service associated with a particular marker. Thus, when the EndTransmission( ) method is called, the transmission details are provided up to that instance of time when the method 28 was called, and the marker is deactivated by terminating its associated handle.

In some instances, a particular marker may be passed to a plurality of data transmission streams which may be broadcast over different channels. In some cases, it may be desirable to know how much information has been transmitted by a group of broadcast streams, for example, associated with a particular content provider. By using the same marker in each of the streams, the GetTransmissionDetails( ) method 36 may be invoked to provide cumulative information about the data flow over the group of streams, referred to as a session.

Since the marker is not associated with the data flow directly, the use of the marker can be extended to measure any event occurring in the system at any level of granularity. Random events that may happen in the system may be monitored using markers which exist within the system as independent entities. As a marker is enabled, it becomes a measurement of an event which may be used to confirm, measure and log necessary information related to that event.

Markers can be provided at any level or granularity of the data transmission. For example, a data transmission may include a number of files, and markers may be associated with each of those files as well as with the overall broadcast that may include a plurality of files. Thus, information may be provided about the transmission of any one of the files and with respect to the overall transmission of files in the broadcast as well as any sub-group of files.

Figure 3A:
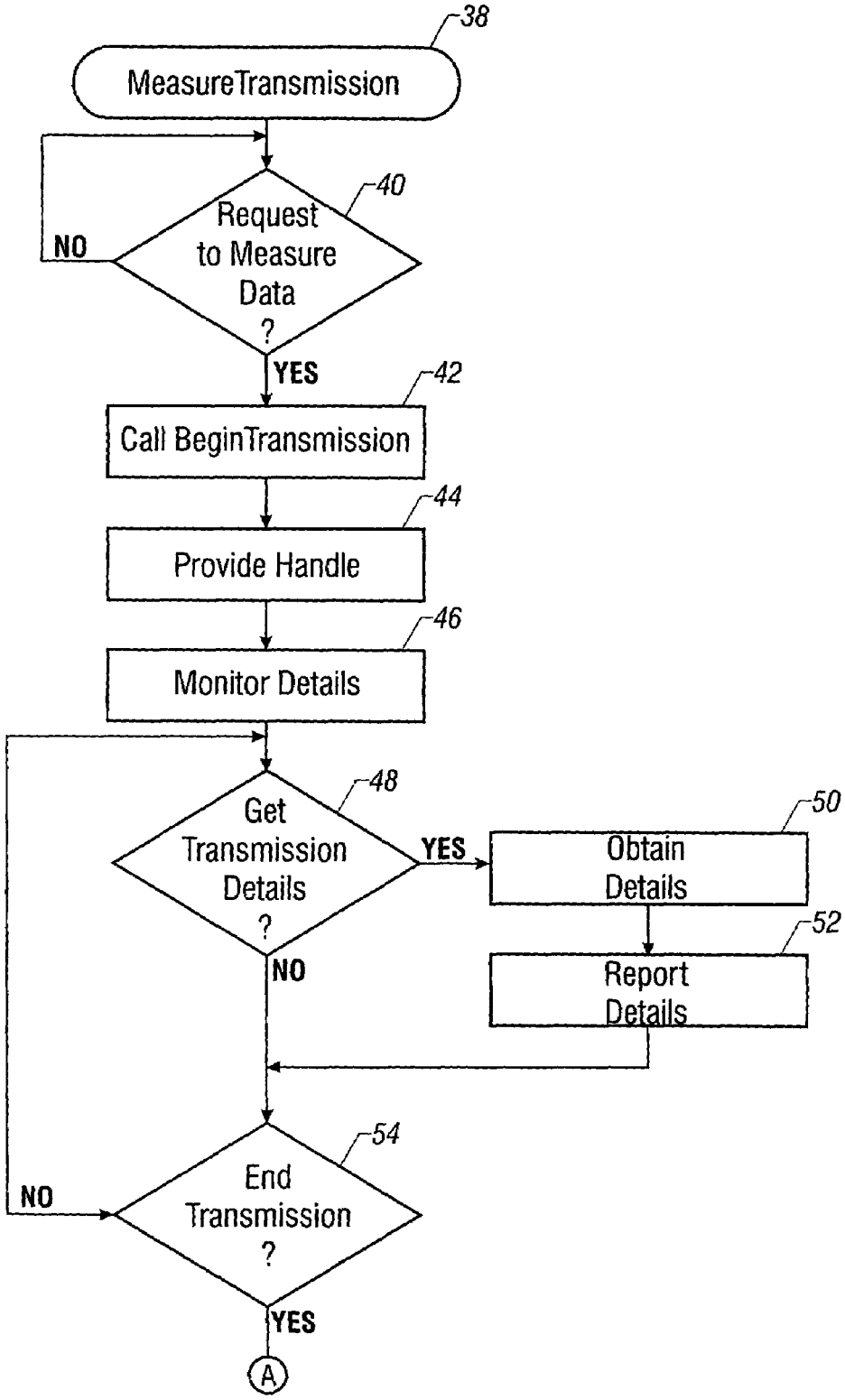
FIG. 3*a* is a flow diagram showing the operational software used on the broadcast encoder or the content provider shown in FIG. 1.

Initially, the MeasureTransmission software 38 awaits a request to measure data which may come from the broadcast encoder application, as indicated in diamond 40 in FIG. 3A. Upon receipt of such a request, the system calls the BeginTransmission( ) method which provides a handle or pointer for the application to access a particular marker, as indicated in blocks 42 and 44. Once a marker has been inserted and a handle has been provided, the transmission details may be cumulated (block 46) by the count server 30, shown in FIG. 2. When the GetTransmissionDetails( )method is invoked, as indicated in diamond 48, the current details are obtained and a report may be provided to a log-in server 18, as indicated in blocks 50 and 52.

Figure 3B:
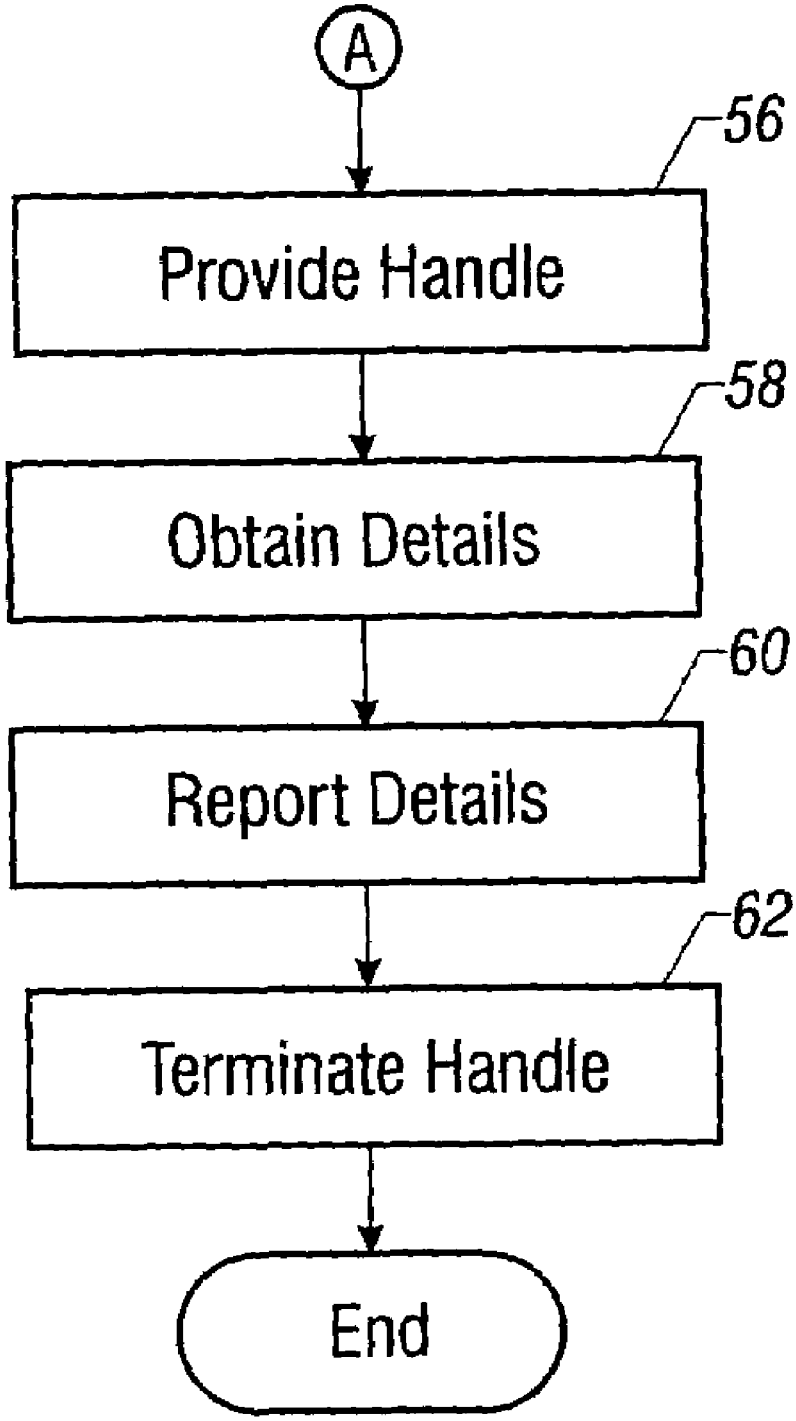
FIG. 3*b* is a continuation of FIG. 3*a*.

When the EndTransmission( )method is called, as indicated in diamond 54, the appropriate handle is used as indicated in block 56 (FIG. 3B). As a result, the transmission details may be obtained and reported as indicated in blocks 58 and 60. Thereafter, the handle is terminated, as indicated in block 62.

While the present invention has been described with respect to a limited number of embodiments, those skilled in the art will appreciate numerous modifications and variations. It is intended that the appended claims cover all such modifications and variations as fall within the true spirit and scope of the present invention.

What is claimed is:

1. A transmission system comprising:

an encoder that combines different transmissions to distribute to a plurality of receivers;

a device that sets a first marker in the transmission; and a counter to track the transmission from the time a handle to the first marker is obtained, said handle to enable said first marker for tracking.

2. The system of claim 1 including a content provider and a broadcast encoder coupled to said content provider.

3. The system of claim 2 wherein said broadcast encoder sets the first marker in a video transmission.

4. The system of claim 2 wherein said content provider sets the first marker in a video transmission.

5. An article comprising a medium for storing instructions that cause a computer to:

set a first marker in a transmission;

call one method to provide a handle to said first marker;

in response to providing said handle, track the on-going transmission from said first marker; and at any time after said handle is provided, call a method other than said one method, said other method to obtain tracking information relative to said first marker without terminating said tracking from said first marker, said tracking information current as of the time said other method is called.

6. The article of claim 5 including instructions that cause the computer to receive web content transmissions and accompanying television broadcasts from a content provider.

7. The article of claim 6 including instructions that cause the computer to receive a web content broadcast with the first marker inserted within the broadcast data, combine the web content broadcast with a television broadcast and transmit the combined broadcast.

8. The article of claim 5 including instructions that cause a computer to transmit said transmission to a plurality of receivers to display on a display device.

9. The article of claim 8 including instructions that cause a computer to provide a continuous data stream, set said first marker and a second marker in said stream, and associate said second marker with a second handle.

10. The article of claim 9 including instructions that cause a computer to call a method which provides transmission details and the handle.

11. The article of claim 9 including instructions that cause a computer to allow said first and second markers to be accessed separately using separate handles so that transmission details associated with different portions of a data transmission can be obtained.

12. The article of claim 5 including instructions that cause a computer to report the transmission.

13. A method comprising:

receiving a handle to a first marker that is set in a transmission, said transmission to be distributed to a plurality of receivers; and tracking the transmission after said first marker, said tracking on-going from the time said handle to said first marker is received.

14. The method of claim 13 wherein on-going tracking includes counting bits transmitted and elapsed time from the time when the first marker is transmitted.

15. The method of claim 13 including receiving web content transmissions and accompanying television broadcasts from a content provider.

16. The method of claim 15 including receiving a web content broadcast with said first marker inserted within the broadcast, combining the web content broadcast with a television broadcast and transmitting the combined broadcast.

17. The method of claim 15 including receiving web broadcast content from a content provider, combining the web broadcast content with television programming at a broadcast encoder and inserting said first marker at the broadcast encoder.

18. The method of claim 13 including invoking a method which obtains current transmission details using said handle, said transmission details current as of the time said method is invoked.

19. The method of claim 18 including providing a second marker and associating said second marker with a second handle.

20. The method of claim 19 including calling a method which provides transmission details and terminates said handle.

21. The method of claim 19 including allowing said first and second markers to be accessed separately using separate handles so that transmission details associated with different portions of a transmission can be obtained.

22. The method of claim 13 including providing a log-in server, reporting a transmission to said log-in server and allowing a third party to access said log-in server to receive transmission reporting.

23. A method for tracking video transmissions comprising:

setting a first marker in a transmission having video content;

invoking a first method to provide a handle to said first marker; and in response to providing said handle, tracking the transmission from the time the handle to the first marker is provided until a time a second method other than said first method is invoked, said second method to obtain current transmission details while said tracking from said first marker continues without interruption, said second method invokable at any time to provide details relative to said first marker.

24. The method of claim 23 including obtaining current transmission details using said handle, said transmission details current as of the time said second method is invoked.

25. The method of claim 24 including providing a second marker and associating said second marker with a second handle.

26. The method of claim 25 including calling a third method other than said first and second methods, said third method to provide transmission details and to terminate the handle.

27. The method of claim 25 including allowing said first and second markers to be accessed separately using separate handles so that transmission details associated with different portions of a transmission can be obtained.

28. The method of claim 23 including receiving a web content broadcast with the first marker inserted within the broadcast, combining the web content broadcast with a television broadcast and transmitting the combined broadcast.

29. The method of claim 23 including receiving web broadcast content from a content provider, combining the web broadcast content with television programming at a broadcast encoder and inserting the first marker at the broadcast encoder.

30. The method of claim 23 including providing a log-in server, reporting a transmission to said log-in server and allowing a third party to access said log-in server to receive transmission reporting.

* * * * *